United States Patent [19]

Möltner

[11] 4,388,819

[45] Jun. 21, 1983

[54] ROLLING MILLS

[75] Inventor: Hermann Möltner, Grevenbroich, Fed. Rep. of Germany

[73] Assignee: Kocks Technik GmbH & Company, Hilden, Fed. Rep. of Germany

[21] Appl. No.: 269,713

[22] Filed: Jun. 2, 1981

[30] Foreign Application Priority Data

Jul. 25, 1980 [DE] Fed. Rep. of Germany ..... 3028210

[51] Int. Cl.[3] ..... B21B 39/08; B21B 35/00

[52] U.S. Cl. ..... 72/234; 72/205; 72/249

[58] Field of Search ..... 72/199, 205, 234, 249, 72/279, 366, 367, 378, 443

[56] References Cited

U.S. PATENT DOCUMENTS 3,962,894 6/1976 Noe et al. ..... 72/249

4,002,048 1/1977 Pozsgay ..... 72/205

FOREIGN PATENT DOCUMENTS 972267 6/1959 Fed. Rep. of Germany .

*Primary Examiner*—Francis S. Husar

*Assistant Examiner*—Jonathan L. Scherer

*Attorney, Agent, or Firm*—Buell, Blenko, Ziesenheim & Beck

[57] ABSTRACT

In a multi-stand stretch-reducing tube-rolling mill, the stands at the entry end forming a first group are driven from a main motor and an auxiliary motor and the remaining stands forming a second group are driven from the main motor and a separate auxiliary motor, the corresponding rotational speeds derived from the main motor and one or other of the auxiliary motors being added by means of a planetary gear in a summing transmission. A single stand between the two groups can be driven from the main motor only. The separate auxiliary motor at the entry end enables control over the tube elongation (or compression) to be effected over a shorter tube length, and thereby more accurately.

4 Claims, 6 Drawing Figures

ROLLING MILLS

The invention relates to improvements in rolling mills and particularly to rolling mills for stretch-reducing tubes having a plurality of rolling stands which are arranged closely in succession one after the other along a rolling line.

In a known rolling mill of this kind, the rolls of all the rolling stands of the rolling mill are driven by a single main motor and a single auxilliary motor by way of a group drive which has planetary gear stages for combining the series of rotational speeds derived from the two motors. The two motors generally drive, by way of interposed reduction gears, two separately disposed trains of gear wheels in a summing transmission which extend parallel to the run-through direction of the work material and which have fixed transmission ratios and impart a basic and additional speed to each rolling stand location where the prevailing basic and additional rotational speeds, provided for the relevant rolling stand, are added by means of a respective planetary gear stage, and the resultant rotational drive speed is transmitted to the drive shaft of the respective rolling stand.

By way of example, the rotational speed of the auxiliary motor is varied if it is desired to vary the elongation and thus the wall thickness of the finished tube by means of this drive in a stretch-reducing rolling mill. If the rotational speed of the auxiliary motor is increased, the elongation increases and the wall thickness of the finished tube is reduced. If the auxiliary rotational speed is reduced, the elongation is reduced and the wall thickness of the finished tube increases. This is because the auxiliary motor speed has a greater influence on the roll speeds towards the discharge end of the rolling line. The adjustment of elongation is effected commonly for all the rolling stands, since the rotational speed ratios vary uniformly from rolling stand to rolling stand.

Rolling mills of this kind have proved to be successful in practical operation and can be controlled and regulated very reliably. This is particularly important in the event of fluctuations of the wall thicknesses in the tubes to be rolled. Such fluctuations can be largely compensated for by a rolling mill of this kind. It is even possible to compress the tube axially instead of elongating it, in order to obtain a finished tube which has a thicker wall than the incoming tube. If the changes in the wall thicknesses required in the aforementioned cases extend over a relatively large length of from, for example, two to three meters and more of the tube to be rolled, a rolling mill having the known drive can be adapted to this and can largely compensate for the difference in the wall thickness which has been established. However, difficulties arise if this difference in the wall thickness extends over a shorter length of tube, since the control path of the rolling mill, within which the elongation varies, is too large if the total elongation is varied by means of the adjusting device.

An object of the invention is to provide a rolling mill for the stretch-reducing of tubes which can be adapted better and more sensitively than the known construction to the varying wall thicknesses of the tubes to be rolled for the purpose of compensation.

In accordance with the invention, a rolling mill for the stretch-reducing of tubes has a plurality of rolling stands which are arranged closely one after the other and whose rolls are driven by a main motor and at least two auxiliary motors by way of a group drive which has planetary gear stages for combining the series of rotational speeds of the two motors derived from the main motor and one or other of the auxiliary motors such that a first group of rolling stands disposed at the entry end and a second group of rolling stands disposed at the delivery end are each driven by a separate auxiliary motor whose rotational speed is independently controllable and is superimposed on the rotational speed of the main motor which is common to all of the stands.

Thus, in accordance with the invention, it is proposed to use two or possibly more auxiliary motors which are independent of one another and each of which drives a different group of stands.

Thus, a change of elongation can be limited to any one of the groups of stands, so that a shorter control path is produced by means of which it is also possible to compensate for differences in the wall thickness over shorter lengths of tube. Reference may be made to German Pat. No. 29 47 233, corresponding to U.S. Pat. No. 4,323,971 issued Apr. 6, 1982 in this connection the change of elongation can then be effected only in the first group of rolling stands at the entry end or only in the second group of rolling stands disposed at the delivery end or, alternatively, in both groups of rolling stands. In the case of change of elongation with only one group of rolling stands, it is advantageous to choose that group of rolling stands which is equipped with the largest number of rolling stands. If all the rolling stand locations are occupied, the design of the summing transmission is the deciding factor, that is to say, the length of the train of gear wheels which is driven from the particular auxiliary motor. Advantageously, the group of stands whose auxiliary motor speed is varied with respect to elongation is the group of stands whose auxiliary motor drives the longer train of gear wheels and thus most of the rolling stands. This can be different if not all the rolling stand locations are occupied. Thus, for example, if not all of the rolling stands at the delivery end are required owing to the desired finished dimensions of the tubes, and some of them are removed from the rolling line, the first group of stands at the entry end which, although it has fewer stand locations, is fully equipped with rolling stands, can have more rolling stands than the second group of rolling stands at the delivery end whose larger number of stand locations is only in part filled with rolling stands.

Furthermore, in the rolling mill in accordance with the invention, it is possible to change the direction of rotation of the additional motor of the first group of rolling stands at the entry end. By way of example, if it is allowed to run in the same direction of rotation as the other auxiliary motor, there results in the region of the first group of roller stands a considerable build-up of pressure which is needed when it is desired to obtain a finished tube which has a thicker wall than the incoming tube. Reference is made to U.S. Pat. No. 4,196,838 in this connection. The high axial pressure produced is then limited in an advantageous manner only to the region of the first group of rolling stands where the diameter of the tube is still relatively large and consequently the risk of buckling of the tube is far less than the region of the second rolling stand disposed at the delivery end.

Although a drive for a stretch-reducing rolling mill is known from German Pat. No. 972,267, in which the two groups of rolling stands and two auxiliary motors in addition to a main motor are also provided, the second auxiliary motor only regulates the tension between the first and second groups of rolling stands.

Elongation can be varied by means of one of the auxiliary motors only in the last-mentioned group of rolling stands, whereas, in this known construction, the first group of rolling stands is driven exclusively by the main motor over a fixed series of rotational speeds which is not varied and whose elongation thus remains constant.

The invention will be further described, by way of example, with reference to the drawings, in which.

Figure 1:
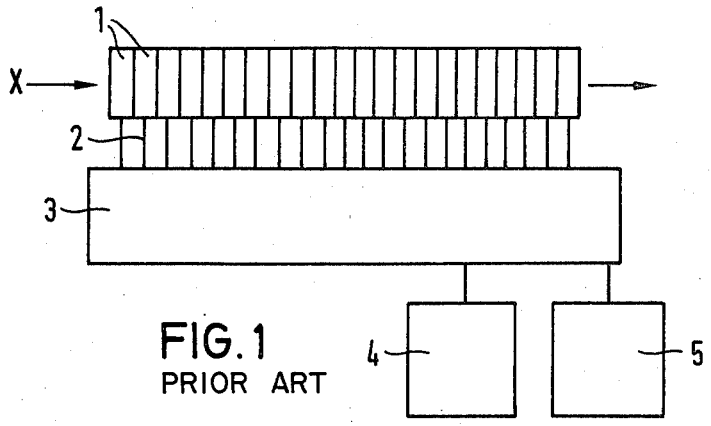
FIG. 1 PRIOR ART
FIG. 1 is a plan view of a known stretch-reducing mill having a main motor and an auxiliary motor.

Referring to FIG. 1, rolling stands 1 disposed one after the other are driven by a summing transmission 3 by way of a drive shaft 2. The summing transmission 3 has a main gear train driven by a main motor 4 and an auxiliary gear train driven by an auxiliary motor 5. The rolling direction in which the tubes to be reduced pass through the rolling stands 1 is shown by the arrow X.

Figure 2:
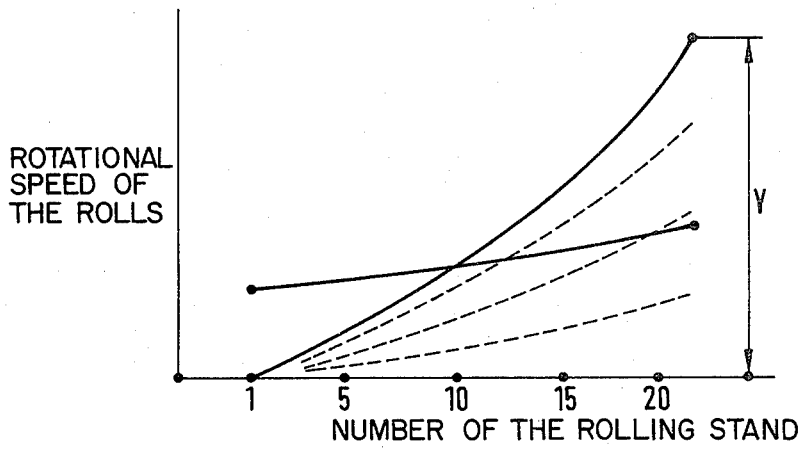
FIG. 2 PRIOR ART
FIGS. 2 and 3 are graphs associated with the rolling mill of FIG. 1.
Figure 3:
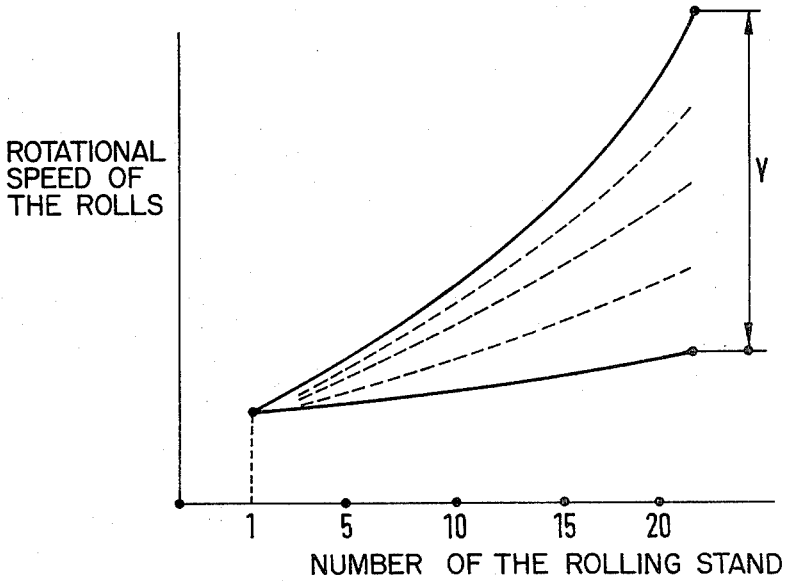
FIG. 3 PRIOR ART

In the graph of FIG. 2, the numbers of the rolling stands 3 are plotted along the abscissa, and the ordinate symbolizes the rotational speeds of the rolls, assuming all the rolls have the same nominal or ideal diameter. The main gear train is designed so that the basic rotational speed, derived from the main motor 4, increases slightly from rolling stand to rolling stand and it already has a predetermined minimum value for the first rolling stand. The auxiliary gear train is designed so that the additional rotational speed, derived from the auxiliary motor 5, is zero for the first rolling stand, although it then increases to a greater extent than the basic speed from the rolling stand. The slope of the curve for the additional rotational speed can be increased or reduced by varying the drive speed of the auxiliary motor 5, this being symbolized by the arrow Y and the diverging curves symbolized by broken lines. If the two rotational speeds for each rolling stand are added together, which is effected in the summing transmission 3 by respective planetary gear stages at the individual rolling stand locations, one obtains the graph of FIG. 3, wherein the value of the rolling speed corresponds to the value of the elongation, thus resulting in the fact that the elongation itself can be infinitely adjusted within a specific range.

Figure 4:
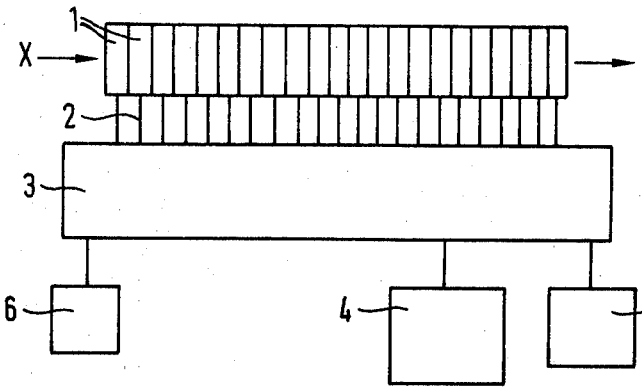
FIG. 4 is a plan view of a stretch-reducing mill in accordance with the invention, having a main motor and two auxiliary motors.

In the same manner as in this prior known construction, the direction in which the work material passes from left to right through the rolling mill, in accordance with the invention, of FIG. 4, is designated X, and the rolling stands 1, the drive shafts 2, the summing transmission 3, the main motor 4 and the auxiliary motor 5 are provided with the same reference numerals. However, a new feature resides in the provision of a second auxiliary motor 6 which is associated with a second auxiliary gear train and which, together with the main motor 4, only drives the, for example, first six rolling stands. The following seventh rolling stand is driven exclusively from the main motor 4, whereas the eighth rolling stand and all the rolling stands following towards the delivery end are driven from the main motor 4 and the auxiliary motor 5. In this manner, two groups of rolling stands are provided, namely the first group of rolling stands at the entry end and the second group of rolling stands at the delivery end, a neutral rolling stand being disposed between the first and second groups of rolling stands and can be included in either one or the other of the groups of rolling stands or in neither of them.

Figure 5:
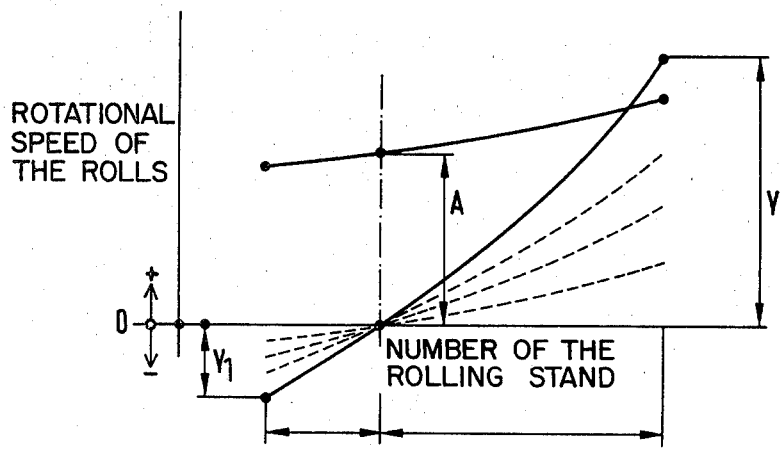
FIGS. 5 and 6 are graphs associated with the rolling mill of FIG. 3.

FIG. 5 corresponds to FIG. 2 and, on the one hand, shows the characteristic of the basic rotational speeds and, on the other hand, shows the diverging array of the additional rotational speeds of the two auxiliary motors 5 and 6. The auxiliary motor 6 of the first group of rolling stands rotates in the opposite direction to the auxiliary motor 5 of the second group of rolling stands so that a second diverging array of additional rotational speeds is produced which lies below a zero line extending through the rotational speed of the neutral, seventh rolling stand. The reason for the latter is that this rolling stand is only driven at the basic rotational speed, and the additional rotational speed is thus zero. Alternatively, the series of additional rotational speeds for the two groups of rolling stands can be chosen such that a discontinuity exists in the speed curve in the region of the neutral, seventh rolling stand. Greatly, differing speed curves can be optionally chosen from the two rotational speed arrays of the first and second groups of rolling stands, this being symbolized by the arrows Y and $Y_1$, whereby the above-mentioned discontinuity can then be produced.

Figure 6:
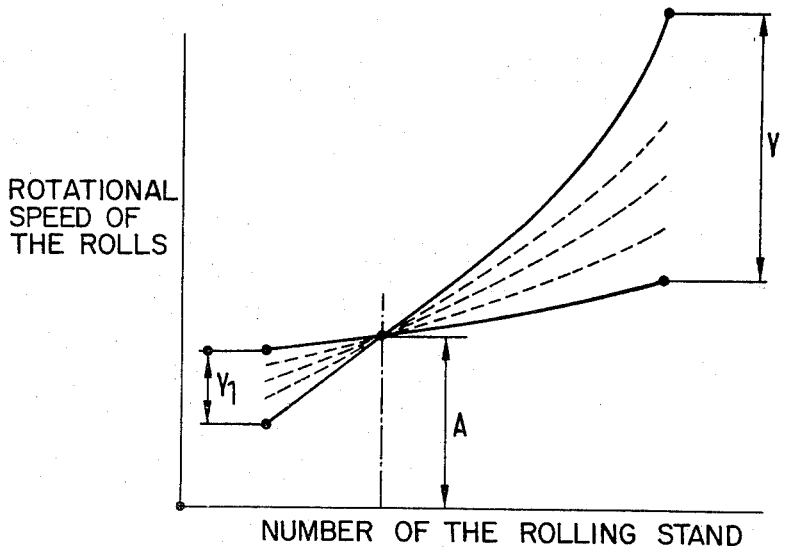

The rotational speed curves illustrated separately in FIG. 5 are added in FIG. 6, that is to say, the basic rotational speed and the associated additional rotational speed in each case. Since the neutral rolling stand disposed at the seventh stand location in the illustrated embodiment is driven only at the basic rotational speed, the rotational speed for this seventh rolling stand is also at the same distance A from the absscisa in FIG. 6 as the basic rotational speed is from the zero line in FIG. 5. The curves have a somewhat steeper characteristic owing to the fact that the basic rotational speeds are added to the additional speeds. In the present embodiment, the characteristic of the minimum rotational speeds or the minimum elongation in FIG. 6 corresponds to the characteristic of the basic rotational speed curve in FIG. 5, since the auxiliary motors 5 and 6 are then stationary.

In the foregoing specification I have set out certain preferred practices and embodiments of my invention, however, it will be understood that this invention may be otherwise embodied within the scope of the following claims.

I claim:

1. A rolling mill for the stretch-reducing of tubes, comprising a plurality of rolling stands which are arranged closely one after the other, a main motor and drive train drivingly connected to all of the rolls in said plurality of roll stands whereby the rolls are driven by said main motor and two auxiliary motors connected to said drive train, said drive train including planetary gear stages for combining the rotational speeds of the two auxiliary motors with that of the main motor such that a first group of rolling stands disposed at the entry end and a second group of rolling stands disposed at the delivery end are each driven by one of said auxiliary motors whose rotational speed is independently controllable and is superimposed on the rotational speed of the main motor which is common to all of the stands.

2. A rolling mill as claimed in claim 1, in which the auxiliary motor of the first group of rolling stands disposed at the entry end is controllable so that it can rotate in either direction.

3. A rolling mill for the stretch-reducing of tubes as claimed in claim 1 or 2 wherein the drive train includes a summing transmission driving all of said roll stands from the main motor and driving a first group of rolling stands at the entry end with a superimposed drive from a first auxiliary motor and a second group of stands at the delivery end with a superimposed drive from a second auxiliary motor.

4. A rolling mill for the stretch reducing of tubes as claimed in claim 1 or 2 wherein a single roll stand between said entry group of stands and said delivery group of stands is driven solely by said main motor.

* * * * *